US008206193B2

(12) United States Patent
Tjøm

(10) Patent No.: US 8,206,193 B2
(45) Date of Patent: Jun. 26, 2012

(54) ACCOUSTIC BUOY

(75) Inventor: Kyrre J. Tjøm, Blommenholm (NO)

(73) Assignee: Abyssus Marine Services AS, Asker (NO)

( * ) Notice: Subject to any disclaimer, the term of this patent is extended or adjusted under 35 U.S.C. 154(b) by 708 days.

(21) Appl. No.: 11/993,467

(22) PCT Filed: Jun. 29, 2006

(86) PCT No.: PCT/NO2006/000250
§ 371 (c)(1),
(2), (4) Date: Feb. 26, 2008

(87) PCT Pub. No.: WO2007/001191
PCT Pub. Date: Jan. 4, 2007

(65) Prior Publication Data

US 2010/0159758 A1 Jun. 24, 2010

(30) Foreign Application Priority Data

Jun. 29, 2005 (NO) ..... 20053187

(51) Int. Cl.
*B63B 22/00* (2006.01)
*B63B 22/08* (2006.01)
*B63B 22/18* (2006.01)

(52) U.S. Cl. ..... 441/6; 441/11; 441/22; 441/24; 441/26

(58) Field of Classification Search ..... 441/6–30
See application file for complete search history.

(56) References Cited

U.S. PATENT DOCUMENTS

| | | | | | |
|---|---|---|---|---|---|
| 1,318,650 | A | * | 10/1919 | Dutka | 441/20 |
| 1,636,447 | A | * | 7/1927 | Standish | 114/327 |
| 1,669,055 | A | * | 5/1928 | Hogg | 441/16 |
| 3,451,079 | A | | 6/1969 | Hagan | |
| 3,460,058 | A | * | 8/1969 | Taplin | 367/4 |
| 3,851,348 | A | * | 12/1974 | Gilbert et al. | 441/21 |
| 3,978,790 | A | * | 9/1976 | Sandelius | 102/388 |
| 4,074,380 | A | * | 2/1978 | Parker | 441/26 |
| 4,209,151 | A | * | 6/1980 | Saunders | 244/138 R |
| 4,443,203 | A | * | 4/1984 | Maertens | 441/22 |
| 4,954,110 | A | * | 9/1990 | Warnan | 441/22 |
| 6,261,142 | B1 | * | 7/2001 | Fiotakis | 441/11 |
| 6,739,924 | B1 | | 5/2004 | Groen | |

FOREIGN PATENT DOCUMENTS

| | | | | |
|---|---|---|---|---|
| EP | 305040 | A1 | * | 3/1989 |
| GB | 2431380 | A | * | 4/2007 |
| JP | 2001106177 | A | * | 4/2001 |
| WO | 9102676 | | | 3/1991 |
| WO | 9845169 | | | 10/1998 |
| WO | 0121474 | | | 3/2001 |

* cited by examiner

*Primary Examiner* — Ajay Vasudeva
(74) *Attorney, Agent, or Firm* — Christian D. Abel

(57) ABSTRACT

A buoy provided preferably for ascending in the water from an initial submerged position. The buoy comprises a buoyancy element positioned at an upper portion of the buoy in the ascending direction. Further the buoy comprises a storing structure for an elongated member positioned below the buoyancy element in the ascending direction, wherein one end of the elongated member is connected to the buoy and the other end of the elongated member is connected to an object submerged in the water. The buoyancy element is provided to obtain a rotation of the buoy around its central axis thereby paying out the elongated member while the buoy is ascending essentially vertically in the water.

11 Claims, 2 Drawing Sheets

ACCOUSTIC BUOY

The invention concerns a buoy which is provided for ascending from a submerged position in the water. However the principles of the invention may also be applicable to a buoy which is prepared for descending.

The buoy can be used for providing access to a submerged object such as for instance an anchor, a lump weight, a heavy weight hawser or any other object to be submerged in the water. In an initial position the buoy is submerged in the water and connected at a fixed distance by suitable means to the submerged object.

In accordance with prior art it is common knowledge to provide a submerged object with a buoy arranged for rising in the water when released from the submerged object.

U.S. Pat. No. 3,755,836 discloses a submarine provided with a communication buoy to be sent from the submarine to the surface of the water. One end of an umbilical cord is attached to the submarine and the other end of the umbilical cord is attached to the positive buoyancy buoy rising in the water.

Other buoys to be placed in a submerged position are disclosed in U.S. Pat. No. 4,954,110 and U.S. Pat. No. 3,793,623.

In accordance with the invention an elongated member such as for instance a line, rope, cable, wire provides a connection between the buoy and the submerged object.

The buoy has means for the storing of an elongated member such as a line. For simplification the elongated member will in the following be referred to as a line. The skilled person will understand that all devices fitting into the term elongated member may be used with the buoy in accordance with the invention. One end, that is the free end of the line, is connected to the submerged object, the other end is attached to the buoy. Initially while the buoy is submerged at a position close to the submerged object most of the line is stored in the buoy. The free end of the line stays connected to the submerged object while the buoy ascends in the water giving out line from the buoy as the buoy rises in the water.

Prior art describes solutions wherein a buoy is arranged to ascend from a submerged position paying out line along with the ascendance in the water. To avoid a tangled line during pay out of the line some parts of the buoy in accordance with prior art, had to be arranged movable relative to the other parts of the buoy. This may be achieved for instance by winding the line on a drum which is able to rotate relative to the other parts of the buoy.

It is an object of the current invention to provide a solution with no moving parts where the line is given out/paid out from buoy without the line being tangled or twisted.

The object of the invention is obtained by the invention as defined in the independent claim, wherein further embodiments are defined in dependent claims.

In accordance with the invention a buoy is provided preferably for ascending in the water from an initial submerged position. The initial position may be on or close to the bottom of the ocean, or somewhere between the bottom and the surface of the water. The buoy comprises a buoyancy element positioned at an upper portion of the buoy, seen in the ascending direction of the buoy. The buoyancy element preferably provides net positive buoyancy to the buoy, this may be accomplished by any conventional manner known to the skilled person. The buoy further comprises a storing structure for an elongated member such as a line, which storing structure is positioned below the buoyancy element in the ascending direction. One end of the elongated member is connected to the buoy and the other end of the elongated member is connected to an object submerged in the water. The submerged object is preferably positioned at the sea bottom.

The buoy is characterized in that the buoyancy element is provided to obtain a rotation of the buoy around its central axis thereby paying out the elongated member while the buoy is ascending essentially vertically in the water. The buoy is arranged so that an essentially vertical equilibrium position is maintained when the buoy is ascending in the water. An unbalance is introduced in the buoyancy element causing the buoy to rotate around its axial axis/central axis due to the effect of a moment.

The buoy comprises parts which are fixed relative to each other, thereby obtaining a buoy with non-movable parts. The storing structure may be constituted by a drum which is arranged fixed or semi-fixed to the buoyancy element. The drum may comprise two drum wheels and a reel arranged in between and fixed to the drum wheels. The line is coiled up onto the drum, preferably around the reel. An axial axis of the reel may be arranged parallel or in line with the axial axis of the buoy. The buoy thereby provides an arrangement where there is no relative movement between the various parts of the buoy. When the buoy starts rising in the water the buoy is forced to rotate due to the arrangement of the buoyancy element and the line is unwinded/paid out from the buoy.

The buoyancy element may be arranged in different ways to obtain a rotation of the buoy. The buoyancy element may be given various shapes to lead the water through the buoyancy element and causing a rotation of the buoy. The buoy may be caused to rotate even if the buoyancy element is provided with only one projecting structure.

The buoyancy element may assume various shapes, for instance the buoyancy element may assume a disc or a cylindrical shape.

In one embodiment of the invention the buoyancy element is arranged with recesses arranged inclined to the central axis of the buoy. The recesses may for instance be arranged as channels in the buoyancy element or may be provided in between projecting structures arranged onto the buoyancy element. Each recess has an inlet opening and an outlet opening wherein the inlet and outlet are placed at two different positions with a distance in between in the circumferential direction which may be equal or vary between two and two recesses. Viewed in a radial plane the inlet and the outlet are positioned with an angle distance in between.

The recesses may be placed at various positions within the outer circumference of the buoyancy element. In one preferred embodiment each recess is arranged with a radial distance to the central axis which radial distance is equal or varies along the longitudinal direction of the recess. In one further preferred embodiment each recess is placed close to the circumference and has an open side surface in an outer axial side surface of the buoyancy element, which axial side surface is positioned at a radial distance from the central axis of the buoy. Further the recess has the inlet opening positioned in the top surface of the buoyancy element and the outlet opening positioned in the bottom surface of the buoyancy element.

When the recess is arranged with a radial distance to the central axis which varies along the longitudinal direction of the recess, the recess may be provided with an inlet opening in the top surface and an outlet opening in the outer axial side surface of the buoyancy element. In this embodiment the radial distance to the central axis decreases as the recess approaches the top surface.

The buoy may be provided with a release mechanism preferably a hardwire, a timer or an acoustically controlled release mechanism to release the buoy from the initial submerged position.

The buoy may be provided with at least one additional buoyancy element preferably positioned at the lower portion of the buoy in the ascending direction.

A transponder may be included in the buoy, preferably that the buoyancy element is arranged at a radially outer position coaxially to the transponder. Further, the reel of the drum may be arranged below the buoyancy element at a radially outer position coaxially to the transponder. The transponder is thereby protected by the various parts of the buoy.

Figure 1:
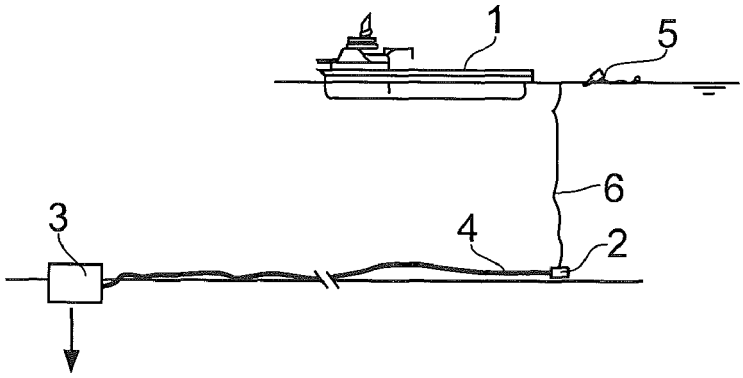
FIG. 1 illustrates the buoy used in a pick-up situation.
Figure 2:
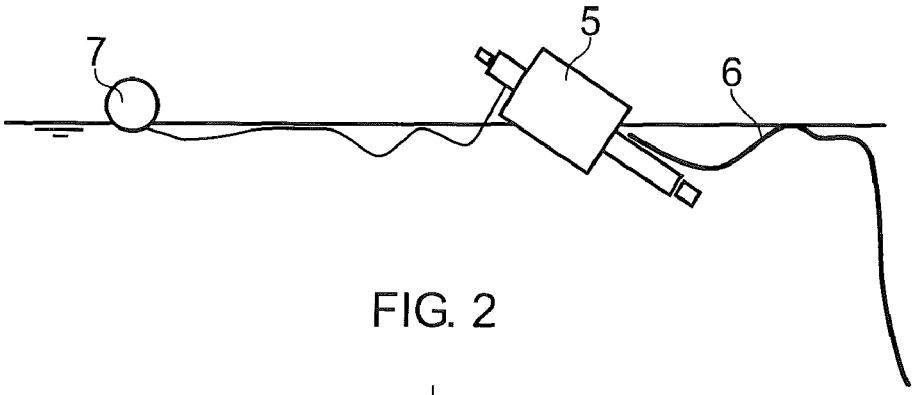
FIG. 2 is a detailed illustration of situation shown in FIG. 1.

FIG. 1 shows a vessel 1 having located a submerged object 2. The object 2 is attached to a heavy weight object such as an anchor 3 by an anchor line 4. When the submerged object 2 is located, a signal such as an acoustic signal is sent to a buoy 5, also submerged and connected to the submerged object 2 at a fixed distance to the submerged object 2. The buoy is provided with a coiled up line 6 having one free end fixed to the submerged object 2. Whereupon receiving the signal the buoy is allowed to give out line while ascending in the water until reaching the surface position as illustrated in FIG. 1. The buoy is ready to be picked up by the vessel and may be provided with a pick up buoy 7 as shown in FIG. 2 to facilitate picking up the buoy 5. The submerged object 2 is thereafter retrieved from its submerged position.

Figure 3:
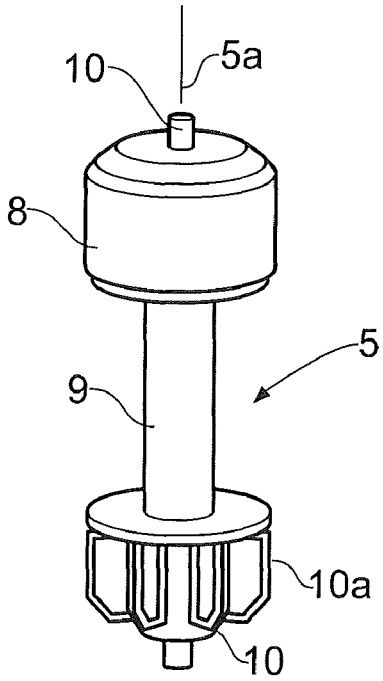
FIG. 3 is a concept illustration of the buoy 5 shown in FIGS. 1 and 2.

The buoy 5 is constituted of a buoyancy element 8 and a storing structure 9, which may be arranged onto a transponder 10 as shown in FIG. 3. The buoyancy element 8 is positioned at the upper portion of the buoy 5. The transponder is protected by a cage element 10*a*.

Figure 4:
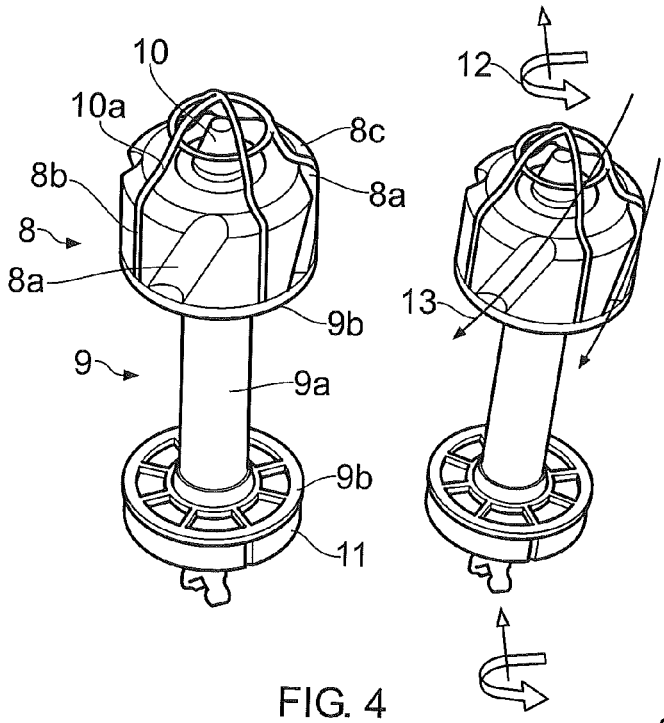
FIGS. 4 and 5 show the buoy arranged with recesses.

FIG. 4 shows the buoy 5 provided with the buoyancy element 8 and an additional buoyancy element 11 at the lower portion of the buoy 5. The storing structure 9 comprises a reel 9*a* and two drum wheels 9*b*. The line 6 is coiled up onto the reel 9*a*. The buoyancy element 8 is provided with recesses 8*a* arranged inclined in the outer axial surface 8*b*. The recesses have openings in the outer axial surface 8*b* and in the top and bottom surfaces 8*c*, 8*d* of the buoyancy element 8. The buoyancy element is further provided by a protection cage 10*a*. When the buoy 5 is released from its submerged position, the buoy ascends in the water due to net positive buoyancy of the buoy provided essentially by the buoyancy element 8. During the ascendance in the water the buoy moves essentially vertical. While ascending the buoy is made to rotate around its central axis 5*a* due to the water led trough the inclined recesses 8*a* arranged in the buoyancy element 8. This rotation of the buoy 5 causes the line 6 (not shown) to unwind untangled from the reel 9*a*. The free end of the line 6 stays connected to the submerged object 2 during the unwinding of the line from the reel 9*a*.

The rotation of the buoy 5 is illustrated by arrows 12 and the water flowing through the recesses 8*a* is illustrated by arrows 13.

Figure 5:
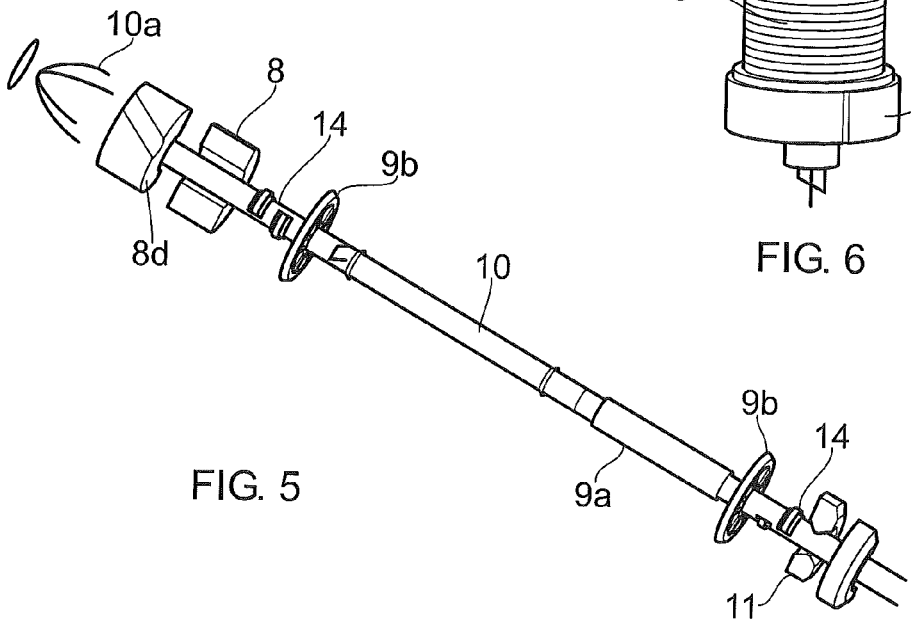

FIG. 5 shows the buoy exploded. The buoyancy element 8 is constituted by two sections to be mounted around the transponder thereby providing a buoyancy element with a cylindrical shape. The additional buoyancy element 11 is also constituted by two sections to be mounted around the transponder thereby providing a buoyancy element with an annular shape.

Figure 6:
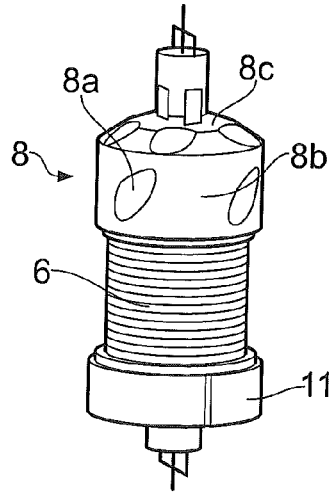
FIG. 6 show the buoy with alternative recesses.

FIG. 6 shows the buoy provided with alternative inclined recesses 8*a*. Each recess 8*a* has an inlet opening in the outer axial surface 8*b* and an outlet opening in the top surface 8*b*. The line 6 is shown winded onto the reel.

The invention claimed is:

1. A buoy provided for ascending or descending in water from an initial submerged position, which buoy comprises a buoyancy element positioned at an upper portion of the buoy in the ascending direction, a storing structure for an elongated member positioned below the buoyancy element in the ascending direction, the storing structure comprising a drum which is non-rotatably fixed relative to the buoyancy element, wherein one end of the elongated member is connected to the buoy and the other end of the elongated member is connected to an object submerged in the water, wherein the buoyancy element is arranged such that a torque, caused by the water acting directly on a surface of the buoyancy element when the buoy is ascending in the water, causes a rotation of the buoy around its central axis, the elongated member thereby being paid out while the buoy is ascending in the water.

2. The buoy in accordance with claim 1, wherein the drum comprises two drum wheels and a reel arranged in between and fixed to the drum wheels, and that an axial axis of the reel is arranged parallel or in line with the axial axis of the buoy.

3. The buoy in accordance with claim 1, wherein the buoy is provided with at least one additional buoyancy element positioned at the lower portion of the buoy in the ascending direction.

4. The buoy in accordance with claim 1, wherein the buoyancy element has a disc or cylindrical shape.

5. The buoy in accordance with claim 1, wherein the buoyancy element is arranged with recesses arranged inclined to the central axis of the buoy, wherein each recess is arranged with a radial distance to the central axis which is equal or varies along the longitudinal direction of the recess.

6. The buoy in accordance with claim 5, wherein each recess has an open side surface in an outer axial surface of the buoyancy element, and an opening in the top and the bottom surface of the buoyancy element.

7. The buoy in accordance with in accordance with claim 5, wherein each recess has an opening in the top surface and the outer axial side surface of the buoyancy element.

8. The buoy in accordance with claim 1, wherein the buoy is provided with a release mechanism to release the buoy from the initial submerged position.

9. The buoy in accordance with claim 1, wherein the elongated element is constituted by a line, a cable having a free end connected to an object positioned at the sea bottom.

10. The buoy in accordance with claim 1, wherein a transponder is included in the buoy.

11. The buoy in accordance with claim 10, wherein the buoyancy element is arranged at a radially outer position coaxially to the transponder.

* * * * *